US008237640B2

(12) United States Patent
Chen

(10) Patent No.: US 8,237,640 B2
(45) Date of Patent: Aug. 7, 2012

(54) LED DRIVER CIRCUIT HAVING A BIAS CURRENT DRAWN FROM A LOAD CURRENT

(75) Inventor: Chang-An Chen, Taipei (TW)

(73) Assignee: Immense Advance Technology Corp., Neihu District, Taipei (TW)

( * ) Notice: Subject to any disclaimer, the term of this patent is extended or adjusted under 35 U.S.C. 154(b) by 255 days.

(21) Appl. No.: 12/786,171

(22) Filed: May 24, 2010

(65) Prior Publication Data

US 2011/0285678 A1 Nov. 24, 2011

(51) Int. Cl.
*G09G 3/32* (2006.01)

(52) U.S. Cl. ..... 345/82

(58) Field of Classification Search ..... 315/247, 315/287, 291; 345/76–84
See application file for complete search history.

(56) References Cited

U.S. PATENT DOCUMENTS 7,321,206 B2 * 1/2008 Kang et al. ..... 315/291
7,583,034 B2 * 9/2009 Lara-Ascorra et al. ..... 315/291
7,830,097 B2 * 11/2010 Kunimatsu ..... 315/291

* cited by examiner

*Primary Examiner* — Chanh Nguyen
*Assistant Examiner* — James Nokham
(74) *Attorney, Agent, or Firm* — Shimokaji & Associates P.C.

(57) ABSTRACT

A LED driver circuit, including a LED module, a bias circuit, a first switch, an inductor, a regulator, a controller, a second switch, and a current-to-voltage converter, is used to provide a load current for the LED module, wherein the bias circuit is biased by a first bias current and the regulator is biased by a second bias current, and the first bias current and the second bias current are drawn from the load current. Besides, the controller can be implemented with a low voltage controller.

11 Claims, 2 Drawing Sheets

LED DRIVER CIRCUIT HAVING A BIAS CURRENT DRAWN FROM A LOAD CURRENT

BACKGROUND OF THE INVENTION

1. Field of the Invention

The present invention relates to a LED driver circuit, and more particularly to a LED driver circuit, of which at least one bias current is drawn from a load current flowing out of a LED module, and a low voltage controller can be used for controlling a switching operation to deliver the load current.

2. Description of the Related Art

FIG. 1 shows the architecture of a prior art LED driver circuit. As shown in FIG. 1, the architecture includes: a LED driver 100, an NMOS transistor 101, a resistor 102, a LED module 103, an inductor 104, and a diode 105.

In the architecture of the prior art LED driver circuit, the LED driver 100, drawing a bias current $I_{bias}$ from an DC voltage source $V_{IN}$—for example 127V, is used for generating a PWM signal $V_G$ with a duty cycle in response to a current sensing voltage $V_{CS}$.

The NMOS transistor 101 is used to control the magnetic flux transformation through the inductor 104 in response to the PWM signal $V_G$. When the NMOS transistor 101 is during a turn-on period, the LED module 103, the inductor 104, the NMOS transistor 101, and the resistor 102 will constitute a conduction path to store the magnetic flux in the inductor 104; when the NMOS transistor 101 is during a turn-off period, a conduction path composed of the LED module 103, the inductor 104, and the diode 105 will be formed to release the magnetic flux from the inductor 104.

The resistor 102, connected between the NMOS transistor 101 and a reference ground, is used for converting the current, which corresponds to the magnetic flux being stored in the inductor 104, to the current sensing voltage $V_{CS}$ when the NMOS transistor 101 is during a turn-on period.

The LED module 103 is the load of the LED driver circuit.

The inductor 104 is used for carrying the magnetic flux to provide a current to drive the LED module 103.

The diode 105 is used for releasing the magnetic flux in the inductor 104 to drive the LED module 103.

Through a periodic on-and-off switching of the NMOS transistor 101, which is driven by the PWM signal $V_G$ generated from the LED driver 100, the input power from the voltage source $V_{IN}$ is transformed through the inductor 104 to the LED module 103 in the form of a regulated current.

However, there are disadvantages in the prior circuit of FIG. 1. First, the LED driver 100 has to be a high voltage controller which is more expensive than a low voltage one. Second, the bias current $I_{bias}$ for the LED driver 100 causes additional power consumption. Third, if the LED module 103 is open circuited due to some abnormal situations, the NMOS transistor 101 will be kept turned on by the LED driver 100, and most of the voltage dropt of the voltage source $V_{IN}$ will be across the diode 105. As such, a substantial leakage current is produced.

Therefore, there is a need to provide a LED driver circuit which is more power saving and cost effective.

Seeing this bottleneck, the present invention proposes a novel LED driver circuit, providing at least one bias current from a load current flowing out of a LED module, and allowing a low voltage controller for controlling a switching operation to deliver the load current.

SUMMARY OF THE INVENTION

The primary objective of the present invention is to propose a LED driver circuit of which at least one bias current is drawn from a load current flowing out of a LED module and therefore will help to save power consumption of the voltage source.

Another objective of the present invention is to propose a LED driver circuit of which a low voltage controller can be used to reduce the cost.

Still another objective of the present invention is to propose a LED driver circuit of which a low leakage current can be achieved when a LED module is open circuited due to some abnormal situations.

To achieve the foregoing objectives of the present invention, a novel LED driver circuit is proposed, the circuit including: a LED module, having a first input end and a first output end, the first input end being coupled to an input voltage; a bias circuit, having a second input end and a second output end, the second input end being coupled to the first output end; a first switch, having a first gate terminal, a first channel input terminal and a first channel output terminal, the first gate terminal being coupled to the second output end; an inductor, coupled between the first output end and the first channel input terminal; a regulator, having a third input end and a third output end, the third input end being coupled to the first channel output terminal; a controller, having a supply voltage input terminal, a current sensing input terminal and a pulse output terminal, the supply voltage input terminal being coupled to the third output end; a second switch, having a second gate terminal, a second channel input terminal and a second channel output terminal, the second gate terminal being coupled to the pulse output terminal, the second channel input terminal being coupled to the first channel output terminal, and the second channel output terminal being coupled to the current sensing input terminal; and a current-to-voltage converter, coupled between the second channel output terminal and a reference ground.

To make it easier for our examiner to understand the objective of the invention, its structure, innovative features, and performance, we use a preferred embodiment together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 2:
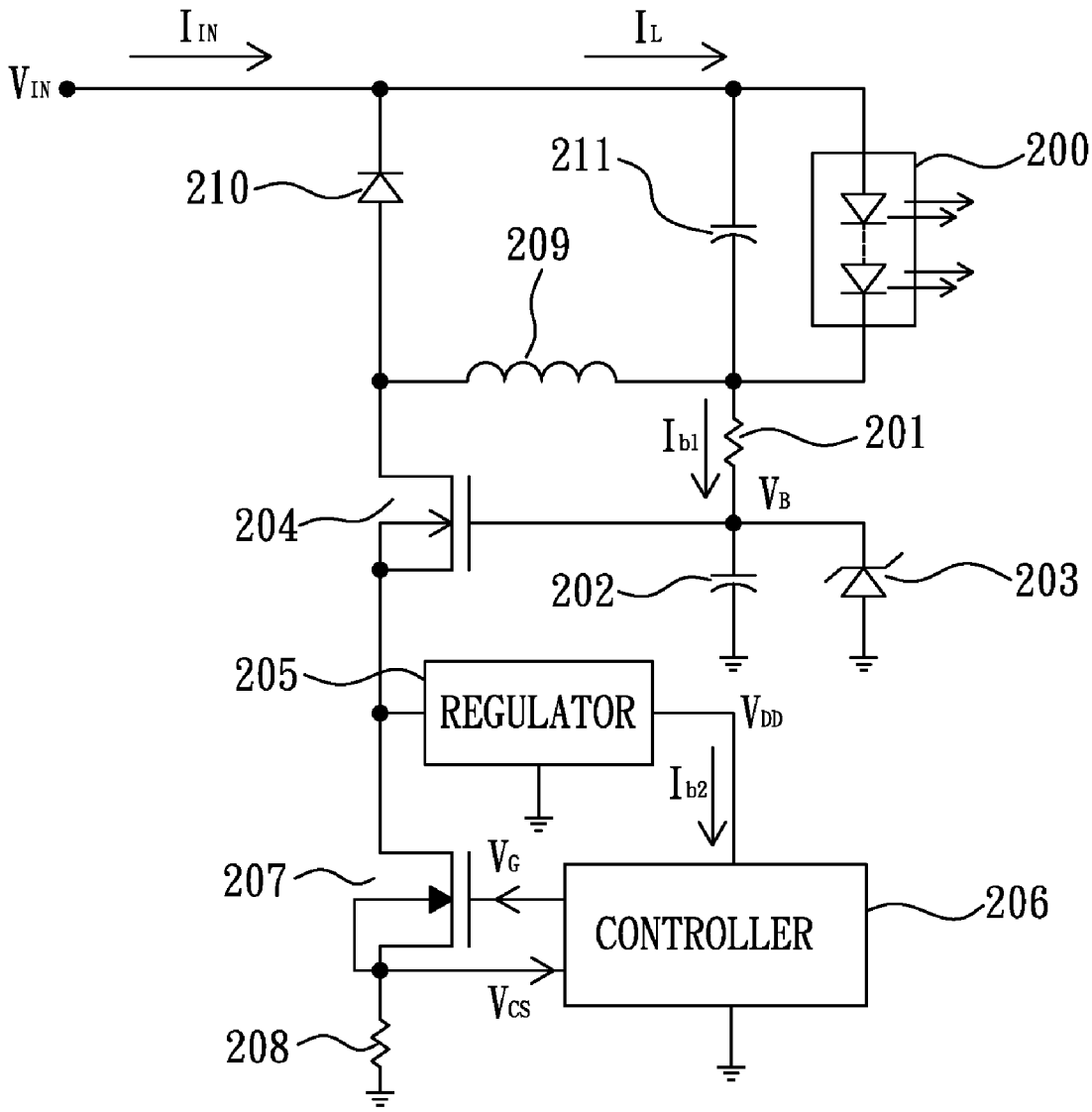
FIG. 2 is the circuit diagram of a LED driver circuit according to a preferred embodiment of the present invention.

Please refer to FIG. 2, which shows the circuit diagram of a LED driver circuit according to a preferred embodiment of the present invention. As shown in FIG. 2, the LED driver circuit includes a LED module 200, a resistor 201, a capacitor 202, a zener diode 203, an NMOS transistor 204, a regulator 205, a controller 206, an NMOS transistor 207, a resistor 208, an inductor 209, a diode 210, and a capacitor 211.

The LED module 200—having an input end and an output end, the input end being coupled to a voltage source $V_{IN}$ and the output end being coupled to one end of the inductor 209—is the load of the LED driver circuit and it carries a load current $I_L$ when the LED driver circuit is in normal operation.

The resistor 201, capacitor 202 and zener diode 203 constitute a bias circuit to provide a bias voltage $V_B$, wherein the bias circuit is coupled to the output end of the LED module 200 and a bias current $I_{b1}$ is drawn therefrom.

The NMOS transistor 204, having a gate terminal coupled to $V_B$, a drain terminal coupled to the other end of the inductor 209, and a source terminal coupled to an input end of the regulator 205, is on when the LED driver circuit is in normal operation, and off when the LED module 200 is open circuited. As such, it can serve to reduce leakage current through the diode 210 when the LED module 200 is open circuited.

The regulator 205 has an input end coupled to the source terminal of the NMOS transistor 204 and an output end to provide a low DC voltage $V_{DD}$, and the current flowing into the regulator is coming from the current flowing out of the LED module 200. The regulator 205 can be, for example but not limited to a combination of a diode and a capacitor.

The controller 206, biased by $V_{DD}$ and consuming a current $I_{b2}$, generates a gating signal $V_G$ according to a current sensing signal $V_{CS}$ to regulate the load current $I_L$. In this circuit, the controller 206 can be implemented with a low voltage one.

The NMOS transistor 207, having a gate terminal coupled to $V_G$, a drain terminal coupled to the source terminal of the NMOS transistor 204, and a source terminal coupled to $V_{CS}$, is used as a control means to regulate the load current $I_L$. The physical size of the NMOS transistor 207 can be much smaller than that of the NMOS transistor 204 to reduce switching loss.

The resistor 208, coupled between the source terminal of the NMOS transistor 207 and a reference ground, is used to carry $V_{CS}$.

The inductor 209, coupled between the output end of the LED module 200 and the drain terminal of the NMOS transistor 204, is used to store a quantity of magnetic energy. The diode 210 is used to discharge the magnetic energy in the inductor 209 to the LED module 200 when the NMOS transistor 207 is off, and the capacitor 211 is used to filter out the noise from the LED module 200.

Figure 1:
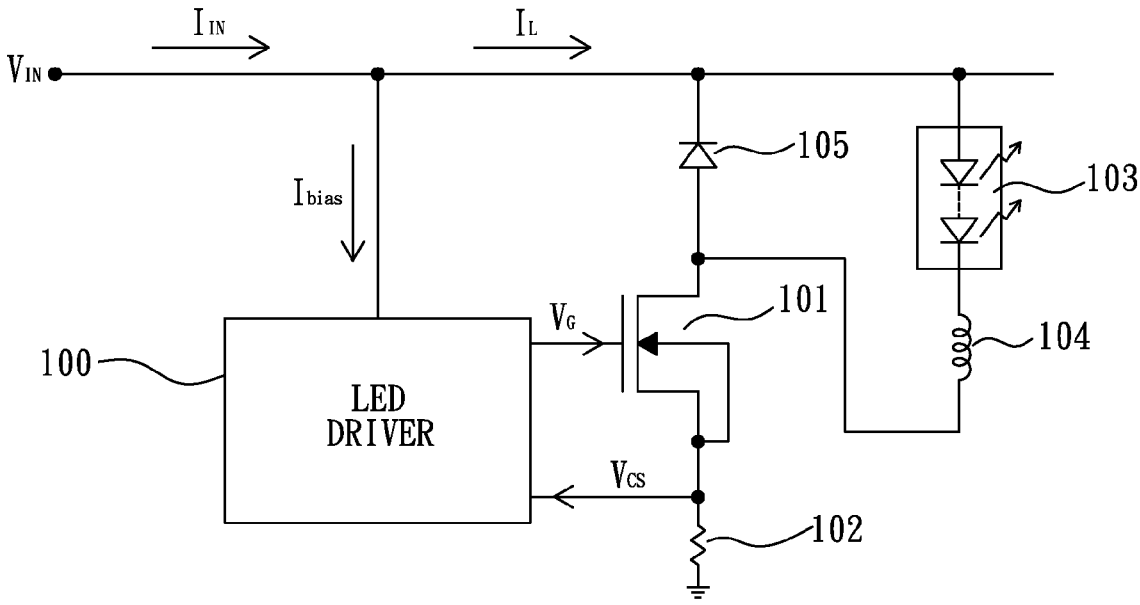
(PRIOR ART) FIG. 1
FIG. 1 is the architecture of a prior art LED driver circuit.

When $V_{IN}$ is applied, a current path consisting of the LED module 200, the resistor 201 and the zener diode 203 is formed first to build up $V_B$ to turn on the NMOS transistor 204. Then a current will flow through the regulator 205 to produce $V_{DD}$ and the controller 206 will start to switch the NMOS transistor 207 to regulate the load current $I_L$. When the LED module 200 is open circuited due to some abnormal situations, $V_B$ will decrease and the NMOS transistor 204 will be switched off, and the switching operation will be shut down. Compared with the LED driver 100 in the prior circuit of FIG. 1, which dissipates much heat due to a large voltage difference between $V_{IN}$ and $V_G$ and a large switching loss caused by $V_G$'s driving a large parasitic gate-source capacitance of the NMOS transistor 101, the controller 206 in the LED driver circuit according to the preferred embodiment of the present invention of FIG. 2 dissipates much less heat due to a much smaller voltage difference between $V_{DD}$ and $V_G$ and a much smaller switching loss caused by $V_G$'s driving a much smaller parasitic gate-source capacitance of the NMOS transistor 207, so the controller 206 can be implemented with a much cheaper one.

As can be seen from the specification above, the bias currents $I_{b1}$ and $I_{b2}$ are from $I_L$, and the controller 206 can be implemented with a low voltage one, therefore the present invention—more power saving and cost effective—does improve the LED driver circuits and is worthy of being granted a patent.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A LED driver circuit, comprising:

a LED module, having a first input end and a first output end, said first input end being coupled to an input voltage;

a bias circuit, having a second input end and a second output end, said second input end being coupled to said first output end;

a first switch, having a first gate terminal, a first channel input terminal and a first channel output terminal, said first gate terminal being coupled to said second output end;

an inductor, coupled between said first output end and said first channel input terminal;

a regulator, having a third input end and a third output end, said third input end being coupled to said first channel output terminal;

a controller, having a supply voltage input terminal, a current sensing input terminal and a pulse output terminal, said supply voltage input terminal being coupled to said third output end;

a second switch, having a second gate terminal, a second channel input terminal and a second channel output terminal, said second gate terminal being coupled to said pulse output terminal, said second channel input terminal being coupled to said first channel output terminal, and said second channel output terminal being coupled to said current sensing input terminal; and a current-to-voltage converter, coupled between said second channel output terminal and a reference ground.

2. The LED driver circuit as claim 1, further comprising a capacitor coupled between said first input end and said first output end.

3. The LED driver circuit as claim 1, further comprising a diode having an anode coupled to said first channel input terminal, and a cathode coupled to said first input end.

4. The LED driver circuit as claim 1, wherein said bias circuit comprises a zener diode for providing a DC bias voltage.

5. The LED driver circuit as claim 1, wherein said regulator generates a supply voltage at said third output end, and said supply voltage is lower than said DC bias voltage.

6. The LED driver circuit as claim 1, wherein said controller is a PWM controller.

7. The LED driver circuit as claim 1, wherein said current-to-voltage converter comprises a resistor.

8. The LED driver circuit as claim 1, wherein said first switch is an NMOS transistor.

9. The LED driver circuit as claim 1, wherein said second switch is an NMOS transistor.

10. The LED driver circuit as claim 1, wherein said first switch is a high breakdown voltage NMOS transistor and said second switch is a low breakdown voltage NMOS transistor.

11. The LED driver circuit as claim 1, wherein said regulator comprises a diode.

* * * * *